US006585405B2

(12) United States Patent
Bruno et al.

(10) Patent No.: US 6,585,405 B2
(45) Date of Patent: Jul. 1, 2003

(54) MIXING LIQUIDS AND ENTRAINMENT MIXING OF VAPOR INTO LIQUIDS

(75) Inventors: Thomas J. Bruno, Broomfield, CO (US); Michael C. Rybowiak, Arvada, CO (US)

(73) Assignee: The United States of America as represented by the Secretary of Commerce, Washington, DC (US)

( * ) Notice: Subject to any disclaimer, the term of this patent is extended or adjusted under 35 U.S.C. 154(b) by 34 days.

(21) Appl. No.: 09/835,254

(22) Filed: Apr. 13, 2001

(65) Prior Publication Data

US 2001/0055240 A1 Dec. 27, 2001

Related U.S. Application Data

(60) Provisional application No. 60/196,999, filed on Apr. 13, 2000.

(51) Int. Cl.[7] ..... B01F 13/08

(52) U.S. Cl. ..... 366/266; 366/274; 366/343; 261/85; 261/91

(58) Field of Search ..... 366/266, 274, 366/273, 318, 342, 343, 169.1, 169.2; 261/85, 91

(56) References Cited

U.S. PATENT DOCUMENTS

| | | | | |
|---|---|---|---|---|
| 485,986 A | * | 11/1892 | Saladin | 366/169.1 |
| 797,512 A | * | 8/1905 | Glauser | 261/85 |
| 1,763,122 A | * | 6/1930 | Bailey | 366/102 |
| 3,495,813 A | * | 2/1970 | Marenghi et al. | 261/91 |
| 3,975,469 A | * | 8/1976 | Fuchs | 366/318 |
| 4,200,597 A | * | 4/1980 | Baum | 261/87 |
| 4,448,685 A | * | 5/1984 | Malina | 366/102 |

OTHER PUBLICATIONS

Bates, R.L., Fondy, P.L., Fenic, V.W., "Impeller characteristics and power," *Mixing Theory and Practice*, Academic Press, NY, 1966, pp. 111–178.

(List continued on next page.)

*Primary Examiner*—Tony G. Soohoo
(74) *Attorney, Agent, or Firm*—William W. Cochran, II

(57) ABSTRACT

Disclosed is a fluid mixer that mixes liquids while simultaneously promoting rapid mixing entrainment of vapor in the liquid. The device includes a vertical rotor mounted centrally on a base assembly. The rotor comprises a tube which is hollow from an open top end to a bottom closed end, having an external screw thread in a right-side configuration relative from top to bottom and one or more holes located in the sidewall of the tube at the bottom of the hollow portion of the tube, preferably located centrally between two flanking surfaces of the screw thread. The base assembly comprises a stirbar and a supporting disk which contains a ceramic magnet. The base rests on the floor of a containment vessel. A magnetic stirring motor is centrally located sufficiently close to and beneath the containment vessel as to achieve magnetic flux coupling with the base magnet. Operation of the mixer develops a liquid vortex in the liquid phase material. As the speed increases, the external screw threads generate turbulence and draw vapor into the liquid from above the tube and urge the vapor into intimate contact with the turbulent, droplet-forming liquid. A circulation develops causing a vortex to develop. As the speed of circulation increases, the surface of the liquid is lowered until it matches the hole in the sidewall of the tube. The liquid enters the holes in the sidewall of the tube along with entrained vapor, and rises through the liquid in the hollow tube, and exits the open top end.

22 Claims, 3 Drawing Sheets

OTHER PUBLICATIONS

Oldshue, J.Y., Connelly, G.L., "Gas–liquid contacting with impeller mixers," *Chemical Engineering Progress*, Mar. 1977, pp. 85–89.

Oldshue, J.Y., Todd, D.B., "Mixing and blending," *Kirk–Othmer Encyclopedia of Chemical Technology*, vol. 15, John Wiley & Sons, NY, 1978, pp. 604–637.

Bakker, A., "The colorful fluid mixing gallery," www.bakker.org. 2 pages.

Hannon, J., "Mixing and chemical reactions in tubular reactors and stirred tanks," Doctorial Thesis, Cranfield Institute of Technology, UK, 1992.

* cited by examiner

MIXING LIQUIDS AND ENTRAINMENT MIXING OF VAPOR INTO LIQUIDS

CROSS-REFERENCE TO RELATED APPLICATIONS

This application claims the benefit of U.S. provisional application No. 60/196,999, filed Apr. 13, 2000.

BACKGROUND OF THE INVENTION

1. Field of the Invention

This invention pertains to a mixing apparatus and more particularly to a magnetically driven rotary mixer for the mixing of liquids and for the rapid mixing entrainment of vapor into liquids.

2. Description of the Background

Mixing of fluids is an integral component in innumerable operations in chemical processing, both for industrial and research applications. Countless instances require mixing of reactants in large-scale stirred chemical reactors in order to optimize blend times and minimize power consumption. On smaller scales in scientific instrumentation, many applications incorporate a fluid mixing operation. These include, for example, measurement apparatus for vapor liquid equilibrium, and for liquid-phase kinetics measurements. Moreover, numerous analytical procedures require the mixing of reagents and reactants in a controlled, closed environment to complete a chemical measurement.

Many liquid mixing operations can be accomplished with devices that provide gentle blending, with little or no entrainment of the vapor that exists above the liquid. Indeed, this may be optimal for some mixing operations. In these instances, a wide variety of magnetic stirring rotors (generally called stirbars) are commercially available in many different sizes and shapes.

For operations that specifically require both the mixing of the liquid and the entrainment of vapor into the liquid, there are limited choices. A search of the patent and open literature did not reveal any commercially available magnetic stirrers that will entrain vapor and maintain a stable rotary motion. The only readily available stirrers of which applicants are aware require an external shaft to drive a mixing rotor. Such devices include the Rushton turbine (which employs six flat turbine blades mounted about a central shaft-driven disk), and modifications (such as the Chemineer CD-6, CD-6/HE 3, etc.) in which the blades have varying degrees of symmetric and asymmetric concavity.

Common problems with shaft mounting designs include inevitable wear and deterioration of the shaft seal, and inhomogeniety due to unswept liquid volume that remains in the region of the seal. These problems make an external shaft device unsuitable for a vapor/liquid equilibrium apparatus or for small-scale chemical reactors. Another common problem with the small chemical mixers driven by external shaft devices is the presence of volume element regions of different surface to volume ratios as compared to the main body of the containment vessel. This same problem occurs when liquid or vapor-circulating pumps are used to provide mixing in many of the existing apparatus for vapor liquid equilibrium.

Accordingly, there is a need for a magnetically driven fluid mixer suitable for mixing the liquid phase and rapidly entraining vapor into the liquid. The present invention satisfies these needs, as well as others, and generally overcomes the deficiencies found in the background art.

SUMMARY OF THE INVENTION

The present invention uses a magnetically driven rotary mixer which mixes liquids and entrains vapor into liquids. In general terms, the invention uses a vertical rotor consisting of a hollow tube having external screw threads and at least one sidewall aperture or hole, the tube being mounted centrally on a base assembly. The rotor and base rest within a containment vessel. A magnetic mixing motor is located beneath the containment vessel to provide a magnetic flux coupling drive to the base and rotor.

More specifically, the tube has a longitudinal bore extending from an open top end of the tube to a closed bottom, the closed bottom end forming a floor at the termination of the longitudinal bore. By way of example and not of limitation, at least one uniform helix in the form an external screw thread is formed on the outside axial surface of the tube in a right side configuration, i.e., in elevation view of the tube in upright position, the external threads are higher on the right side of the tube than on the left side. At least one hole pierces the tube's sidewall at a point above the floor which is defined by the closed bottom end of the longitudinal bore. The bottom end of the tube is fixedly attached or integrally molded with a base assembly comprising a disk and a linear magnet. The disk has a flat bottom surface. The stirbar extends radially from the perimeter of the tube along the top of the disk, the stirbar being either fixedly attached to or integrally molded with the disk. The rotational axes of both the rotor and base are vertically aligned and are preferably perpendicular to the flat bottom surface of the disk. A magnet preferably comprising strontium carbonate—iron oxide, is enclosed within the disk. The disk rests on the floor of a containment vessel capable of containing the tube and base. A magnetic stirring motor is disposed beneath the containment vessel and is coupled by magnetic flux with the base magnet.

As the magnetic stirring motor operates, the tube and base of the invention rotate in a counter-clockwise direction (as observed from a plan view) within the containment vessel, permitting robust mixing of liquid within the mixing containment vessel. As mixing proceeds, liquid is urged away from the rotor, forming a vortex. The speed of the mixing motor is controlled such that the lowest surface of the vortex forms at approximately the same plane as the sidewall hole or aperture. At the same time, vapor within the containment vessel is drawn down by the rotating action of the helix and is robustly mixed with liquid. The vapor is drawn through the hole 108 in the sidewall of tube 102, and the vapor rises through the liquid in the longitudinal bore, thus promoting entrainment of the vapor into the liquid.

The present invention may therefore comprise an apparatus for mixing liquid and for entrainment mixing of vapors in liquid which comprises a tube having an open top end and a longitudinal bore extending into the tube from an open top end to a closed bottom end, the closed bottom end forming a floor within the longitudinal bore, the tube also having an exterior bottom end, the tube further having an exterior axial surface between the open top end and the exterior bottom end, the exterior axial surface having at least one helix in the form an external screw thread, the tube also having a sidewall between the exterior axial surface and the longitudinal bore, the sidewall also defining at least one aperture for circulation of vapor.

The present invention may further comprise an apparatus for mixing liquid and for entrainment mixing of vapors in liquid comprising a tube having an open top end and a longitudinal bore extending into the tube from the open top end to a closed bottom end, the closed bottom end forming a floor within the longitudinal bore, the tube also having an exterior bottom end, the tube further having an exterior axial surface between an open top end and an exterior bottom end, the exterior axial surface having at least one helix in the form an external screw thread, the tube also having a sidewall between the exterior axial surface and the longitudinal bore, the sidewall also defining at least one aperture through the sidewall for circulation of vapor; a base comprising, a disk having a top surface and a substantially flat bottom surface, the top surface having an area greater than an area of a bottom end of the tube, the bottom end of the tube being fixedly attached to the disk such that the rotational axes of the disk and the tube are substantially aligned and are substantially perpendicular to a substantially flat bottom end of the disk, at least one bar fixedly attached to or integrally molded with the top of the disk on an annular area of the top end of the disk outside of a perimeter of the tube, the bar aligned substantially radially from the rotational axis of the disk and a magnet disposed within the disk.

The present invention may further comprise a method for entraining vapor in liquids comprising: placing a tube in a container, the tube having an open top end and a longitudinal bore extending into the tube from the open top end to a closed bottom end, the closed bottom end forming a floor within the longitudinal bore, the tube also having an exterior bottom end, the tube further having an exterior axial surface between the open top end and the exterior bottom end, the exterior axial surface having at least one helix in the form of an external screw thread, the tube also having a sidewall between the exterior axial surface and the longitudinal bore, the sidewall also defining at least one aperture for circulation of vapor, providing liquid in the container; providing vapor in the container, rotating the tube to a speed sufficient to cause the liquid to be urged away from the tube, forming a vortex, such that a lowest point on a surface of the vortex is substantially level with the aperture, whereby the liquid is robustly mixed with the vapor in an area adjacent to the aperture, the vapor being drawn through the aperture, and the vapor being entrained into the liquid.

An advantage of the present invention is the robust mixing of a liquid that can be achieved within a containment vessel and the simultaneous entrainment of vapor into the liquid. The present invention provides superior results that have not hereto for been achievable by prior art devices.

Further advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings.

DETAILED DESCRIPTION OF THE INVENTION

Figure 1:
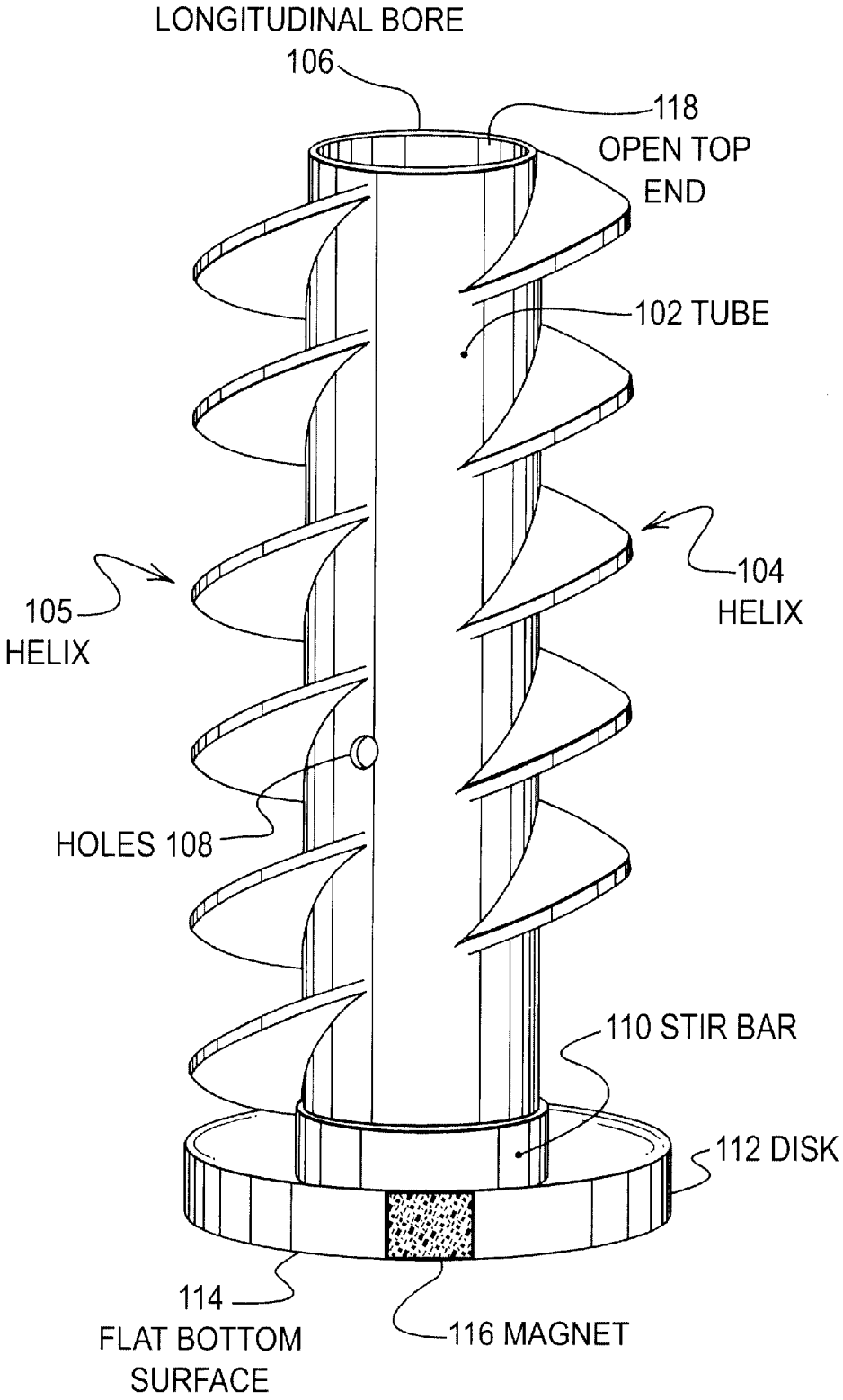
FIG. 1 is an elevation view of a tube and base assembly of the vapor entraining apparatus.

For illustrative purposes, an implementation of the present invention is embodied in the apparatus generally shown in the drawings wherein like reference numerals denote like parts. It will be appreciated that the apparatus may vary as to configuration and as to details of the parts without departing from the basic concepts as disclosed herein. The present invention is disclosed in terms of use with fluids. It should be readily apparent, however, that the rotor of the invention may be utilized with a variety of mixing applications.

Figure 2:
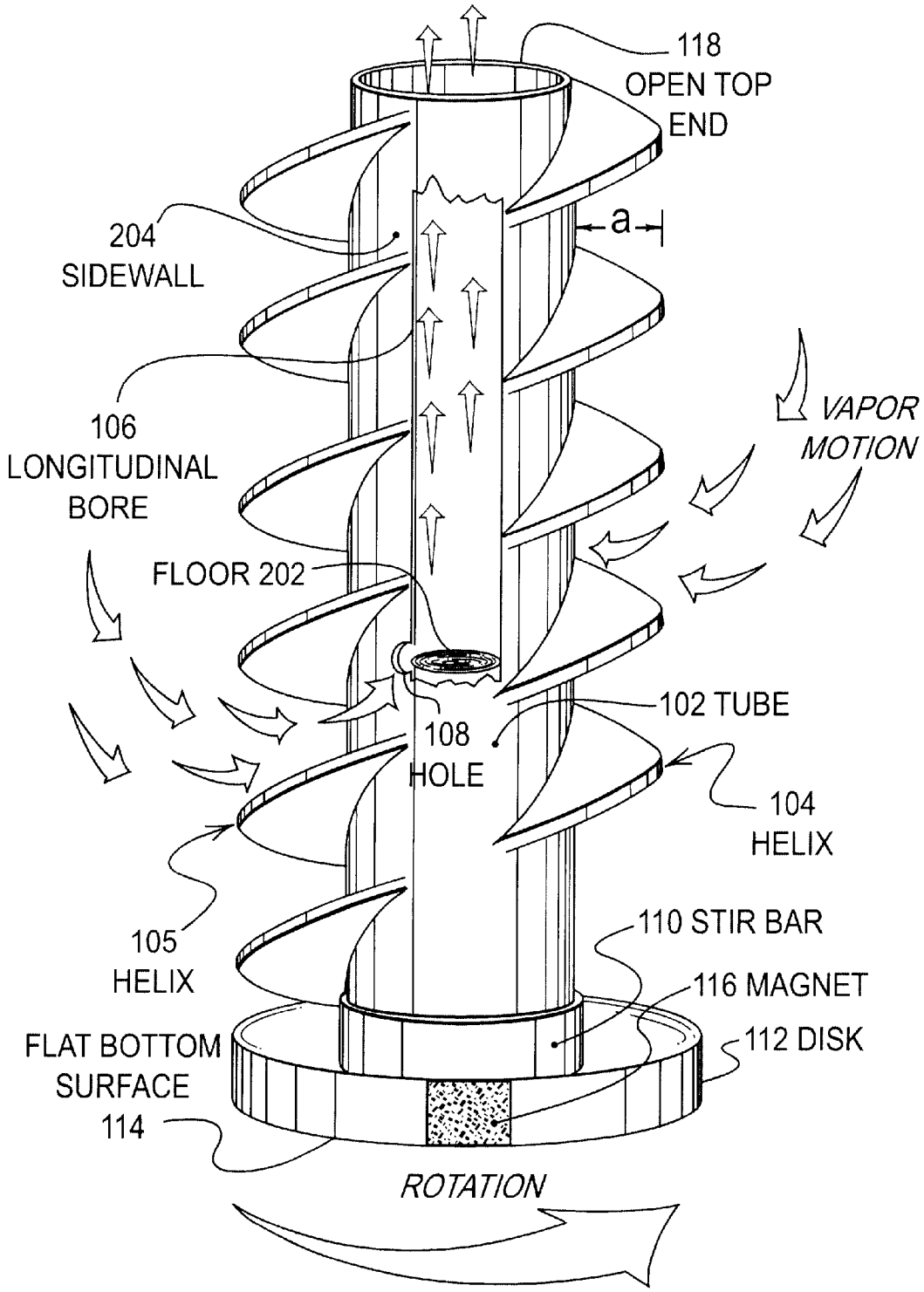
FIG. 2 is an elevation view including a partial cut-out of the tube and base assembly illustrating the longitudinal bore and the floor of the longitudinal bore within the tube.
Figure 3:
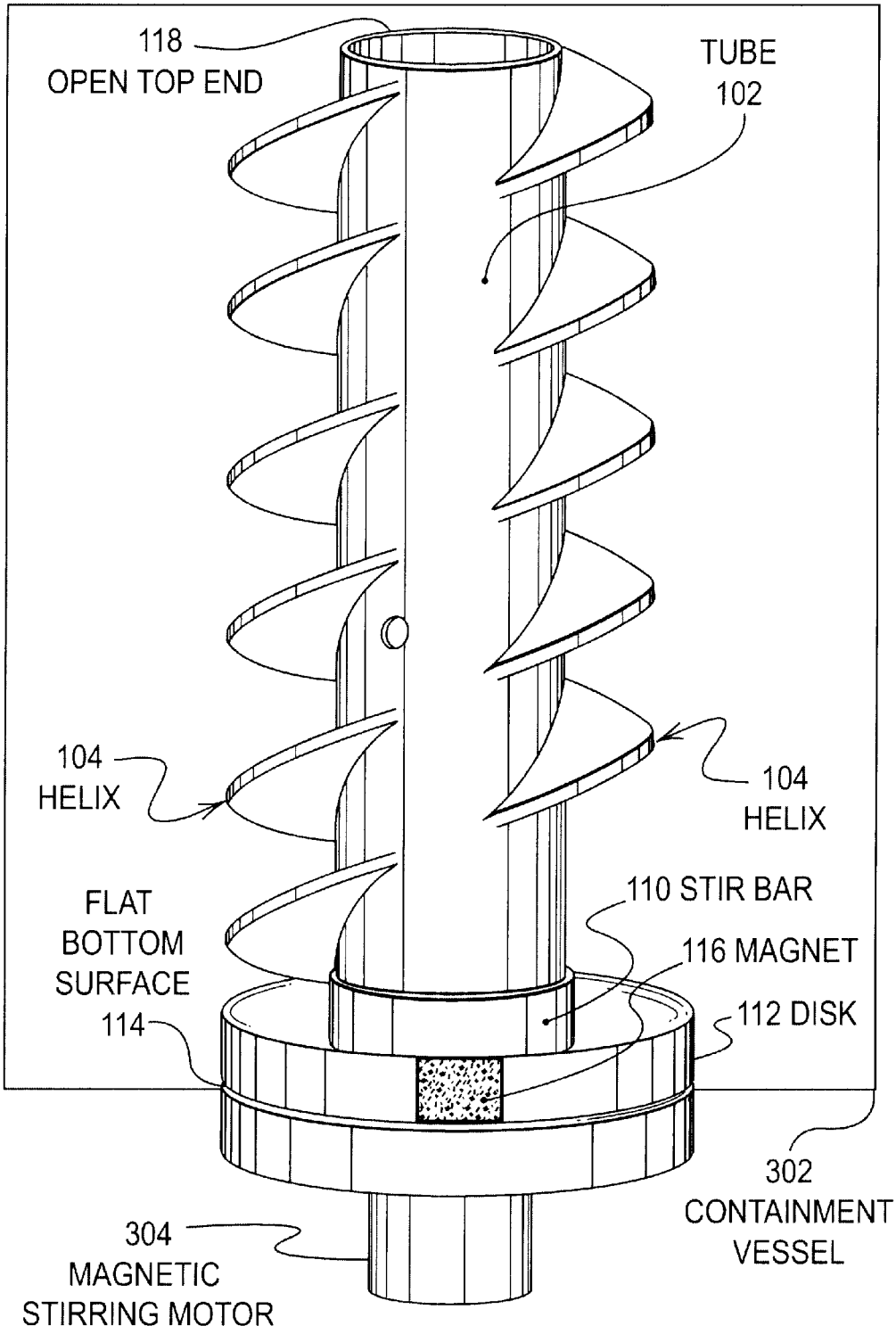
FIG. 3 is an elevation view of the tube and base assembly in use with a containment vessel and magnetic stirring motor.

Referring to FIG. 1, FIG. 2 and FIG. 3, a magnetically driven mixing apparatus in accordance with the present invention is shown. The invention includes a tube 102 with a double external screw thread or helix 104, 105 integrated onto the outer surface of the tube 102. It will further be appreciated that the invention could be embodied in versions comprising a single screw thread or other numbers of multiple screw threads.

The screw threads are configured in "right-side" form, i.e., in elevation view of the tube in upright position; the external threads are higher on the right side of the tube than on the left side. The screw threads may have a thread height equal to three quarters of the diameter of the tube measured from the longitudinal axis of the tube to the root of the screw, i.e., to the bottom of the groove between the two flanking surfaces of the threads. The threads also preferably have a separation substantially as shown between each flanking surface of the threads. However, the threads may be varied in structure and configuration as required.

The tube 102 also has a longitudinal bore 106 from an open top end of the tube 102 to a closed bottom end, the closed bottom end defining a floor 202 of the longitudinal bore. Two holes 108 pierce the sidewall 204 of the tube 102, preferably at the root of the external screw threads 104, i.e., at the bottom of the groove between two flanking surfaces of the thread. The holes are also preferably positioned tangent to the floor 202 of the longitudinal bore 106, i.e., so that the lowest point on the circumferential perimeter of each of the holes meets the plane formed by the floor 202. The holes are also preferably symmetrically distributed about the longitudinal axis of the tube (i.e., for two holes, positioned at 180 degrees from each other on a plane perpendicular to the longitudinal axis of the tube 102). It will further be appreciated that the invention could be embodied in versions comprising one or several holes similarly symmetrically distributed about the longitudinal axis of the tube. However, accommodation of more than three such holes in the sidewall of the tube may unduly compromise the structural integrity of the tube. The holes communicate with the longitudinal bore 106, and serve dual purposes that are more fully described herein below. These holes may be drilled at an angle normal to the pitch diameter of the tube or at more optimal angles as required by a particular application.

The bottom end of the tube 102 is fixedly attached to a base assembly comprising a disk 112, having a flat bottom surface, and a linear magnet 110. The tube is fixedly mounted on or otherwise attached to or integrally molded with the disk 112, such that the rotational axes of the tube and the disk are vertically aligned and preferably perpendicular to the flat bottom surface of the disk. The linear magnet is comprised of one bar, which extends radially from opposite exterior sides of the bottom of the tube. The bar is fixedly attached to or integrally molded with the top surface of the disk. The flat bottom surface 114 of the disk rests on the flat level floor of a containment vessel 302. The tube and base assembly is preferably constructed from Delrin.

A nonconductive, preferably ceramic magnet 116 is mounted inside of the disk component 112 of the base. The magnet preferably comprises strontium carbonate—iron oxide. Any exposed surfaces of the magnet may be coated with a thermally cured inert material (such as a phenolic or a Teflon layer) to prevent decay due to chemical attack.

A ceramic magnet was chosen because it produces a much stronger field than the common permanent magnets that are typically used in magnetic stirring applications, and it can be used to much higher temperatures. The increased field strength allows the tube 102 and base disk 112 to be operated inside of stainless steel pressure vessels without appreciable loss of flux. Stronger magnets (such as samarium-cobalt) were deemed unsuitable because the much higher field of these magnets would cause an unfavorable increase in friction at the base of the rotor.

It will further be appreciated that the invention could be embodied in a version having three small studs added to the flat bottom of the disk base 112, positioned 120 degrees apart and equidistant from the rotational axis of the disk 112, each projecting sufficiently to cause a separation between the bottom of the disk and the floor of the containment vessel, thus forming a support that decreases friction between the disk 112 and the containment vessel. It will further be appreciated that the invention could be embodied in versions comprising three nylon screws in place of the three small studs.

A magnetic stirring motor 304 is closely positioned under the containment vessel 302 such that a magnetic flux coupling is achieved with the magnet disposed within the disk component 112 of the base. The magnetic stirring motor may be selected from the common laboratory variety of the submersible variety, electric or pneumatic.

Operation of the magnetic stirring motor 304 spins the rotor with increasing angular velocity, gradually developing a liquid vortex in the liquid phase. Speed of the rotor is controlled such that the lowest surface of the vortex forms at the plane of the sidewall holes. As the mixing continues, the external screw thread 104 generates turbulence at the surface of the liquid near the rotor and ambient vapor is entrained into the liquid. The threads also draw vapor into the liquid from above the tube 102. This vapor is thus urged into intimate contact with the turbulent, droplet-forming liquid. Circulation then develops whereby the vapor that is pulled into the liquid enters the holes 108 in the sidewall of the tube, rises through the liquid in the longitudinal bore 106, and exits the open top end 118.

This circulation promotes the rapid approach to chemical equilibrium and mass transfer that is vital in many measurement and chemical reaction procedures. This circulation can be demonstrated by operating the rotor in a beaker of water with a magnetic stirring motor. As the turbulent entrainment region is formed by the external right-hand screw threads, bubbles are visible rising in the water in the longitudinal bore. This vapor circulation can be made very clear by slowly adding water into the longitudinal bore during the rotation, and observing the rapidly rising air bubbles.

The holes in the tube of the apparatus upon which the initial testing was performed were drilled approximately perpendicular to the longitudinal axis of the tube. In cases in which the gas viscosity is relatively high, it may be desirable to drill the holes at an oblique angle, thus forming an angle of attack that would be an aid in drawing vapor into the longitudinal bore.

The device can be constructed from many common polymeric materials such as Teflon, glass-filled Teflon or Delrin, ceramics, or other nonmagnetic metals such as titanium or some stainless steels. The choice depends upon the fluids present in the mixing application as well as the mixing conditions under consideration.

The present invention therefore provides a unique system for mixing liquids and entrainment mixing of vapor into liquids. The present invention provides a superior method of entrainment and mixing that has not hereto for been achievable in magnetically coupled mixers. The present invention provides robust mixing of a liquid that can be achieved within a containment vessel with the simultaneous entrainment of vapor into the liquid that has not been provided by prior art devices. The present invention is simple and easy to implement and provides superior results.

The foregoing description of the invention has been presented for purposes of illustration and description, It is not intended to be exclusive or to limit the invention to the precise form disclosed, and other modifications and variations may be possible in light of the above teachings. For example, the screw threads can be made to be either right-side or left-side screw threads and the device can be rotated accordingly. Further, the relative dimensions can be modified dependent on scaling factors, liquid viscosity, vapor density, etc. without extending beyond the spirit and scope of the present invention. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

The invention claimed is:

1. An apparatus for mixing liquid and for entrainment mixing of vapors in liquid comprising:

a freestanding tube having an open top end and a longitudinal bore extending into said tube from an open top end to a closed bottom end, said closed bottom end forming a floor within said longitudinal bore, said tube also having an exterior bottom end, said tube further having an exterior axial surface between said open top end and said exterior bottom end, said exterior axial surface having at least one helix in the form an external screw thread, said tube also having a sidewall between said exterior axial surface and said longitudinal bore, said sidewall also defining at least one aperture for circulation of vapor.

2. An apparatus as recited in claim 1 wherein said aperture is located centrally between two flanking surfaces of said screw thread.

3. An apparatus as recited in claim 1 wherein said aperture is a circular bore.

4. An apparatus as recited in claim 3 wherein said circular bore is located centrally between two flanking surfaces of said screw thread.

5. An apparatus as recited in claim 3 wherein said circular bore is located centrally between two flanking surfaces of said screw thread.

6. An apparatus as recited in claim 1 wherein the height of said external screw thread, measured from a crest of said external screw thread to a lowest adjacent point between flanking surfaces of said screw thread is at least equal to a radius of said tube measured from a longitudinal axis of said tube to said exterior axial surface of said tube at said lowest point between flanking surfaces of said screw thread.

7. An apparatus as recited in claim 1 further comprising:

a base comprising:

a disk having a top surface and a substantially flat bottom surface, said top surface having an area greater than an area of a bottom end of said tube, said bottom end of said tube being fixedly attached to said disk such that rotational axes of said disk and said tube are substantially aligned and are substantially perpendicular to said substantially flat bottom of said disk;

at least one bar fixedly attached to or integrally molded with the top of said disk on the annular area of the top of said disk outside the perimeter of said tube, said bar aligned substantially radially from the rotational axis of said disk; and a magnet disposed within said disk.

8. An apparatus as recited in claim 1 wherein said screw thread has a thread depth at least equal to a radius of said outside surface of said tube, and further comprising:

a base comprising;

a disk having a top surface and a substantially flat bottom surface, said top surface having an area greater than an area of a bottom end of said tube, said bottom end of said tube being integrally molded with said disk such that rotational axes of said disk and said tube are substantially aligned and are substantially perpendicular to a substantially flat bottom of said disk;

at least one bar fixedly attached to or integrally molded with the top of said disk on the annular area of the top of said disk outside of the perimeter of said tube, said bar aligned substantially radially from the rotational axis of said disk; and a magnet disposed within said disk;

a mixing vessel capable of containing said tube and said base; and a magnetic motor disposed beneath said mixing vessel and coupled by magnetic flux with said magnet disposed within said disk.

9. An apparatus as recited in claim 1 wherein said aperture is located centrally between two flanking surfaces of said screw thread.

10. An apparatus as recited in claim 1 wherein said aperture is a circular bore.

11. An apparatus as recited in claim 1 wherein the height of said external screw thread, measured from a crest of said external screw thread to a lowest adjacent point between flanking surfaces of said screw thread is at least equal to a radius of said tube measured from a longitudinal axis of said tube to said exterior axial surface of said tube at said lowest point between flanking surfaces of said screw thread.

12. An apparatus for mixing liquid and for entrainment mixing of vapors in liquid comprising:

a tube having an open top end and a longitudinal bore extending into said tube from the open top end to a closed bottom end, said closed bottom end forming a floor within said longitudinal bore, said tube also having an exterior bottom end, said tube further having an exterior axial surface between an open top end and an exterior bottom end, said exterior axial surface having at least one helix in the form an external screw thread, said tube also having a sidewall between said exterior axial surface and said longitudinal bore, said sidewall also defining at least one aperture through said sidewall for circulation of vapor;

a base comprising;

a disk having a top surface and a substantially flat bottom surface, said top surface having an area greater than an area of a bottom end of said tube, said bottom end of said tube being fixedly attached to said disk such that the rotational axes of said disk and said tube are substantially aligned and are substantially perpendicular to a substantially flat bottom end of said disk;

at least one bar fixedly attached to or integrally molded with said top of said disk on an annular area of said top end of said disk outside of a perimeter of said tube, said bar aligned substantially radially from said rotational axis of said disk; and a magnet disposed with said disk.

13. An apparatus as recited in claim 12 wherein said aperture is a circular bore.

14. An apparatus as recited in claim 13 wherein said circular bore is located substantially tangential to said floor.

15. An apparatus as recited in claim 13 wherein said circular bore is located substantially tangential to said floor and is located centrally in a root of said external screw thread.

16. An apparatus as recited in claim 12 further comprising:

a mixing vessel capable of containing said tube and said base; and a magnetic motor disposed beneath said mixing vessel and coupled by magnetic flux with said magnet.

17. A method for entraining vapor in liquids comprising:

placing a tube in a container, said tube having an open top end and a longitudinal bore extending into said tube from said open top end to a closed bottom end, said closed bottom end forming a floor within said longitudinal bore, said tube also having an exterior bottom end, said tube further having an exterior axial surface between said open top end and said exterior bottom end, said exterior axial surface having at least one helix in the form of an external screw thread, said tube also having a sidewall between said exterior axial surface and said longitudinal bore, said sidewall also defining at least one aperture for circulation of vapor;

providing liquid in said container;

providing vapor in said container;

rotating said tube to a speed sufficient to cause said liquid to be urged away from said tube, forming a vortex, such that a lowest point on a surface of said vortex is substantially level with said aperture, whereby said liquid is robustly mixed with said vapor in an area adjacent to said aperture, said vapor being drawn through said aperture, and said vapor being entrained into said liquid.

18. A method for entraining vapor in liquids as recited in claim 17 further comprising:

providing a disk having a top surface and a substantially flat bottom surface, said top surface having an area greater than an area of a bottom end of said tube, said bottom end of said tube being fixedly attached to said top surface of said disk such that rotational axes of said disk and said tube are substantially aligned and are substantially perpendicular to said substantially flat bottom of said disk;

providing at lest one bar fixedly attached to said top of said disk on an annular area of said top of said disk outside a perimeter of said tube, said bar aligned substantially radially from said rotational axis of said disk; and providing a magnet disposed within said disk.

19. A method for entraining vapor in liquids as recited in claim 18 further comprising:

providing a magnetic motor disposed beneath said mixing vessel and coupled by magnetic flux with said magnet;

energizing said magnetic motor such that said tube and said base are rotated and said liquid is urged away from said tube, forming a vortex, such that a lowest point on surface of said vortex is substantially level with said aperture, whereby said liquid is robustly mixed with said vapor in the area adjacent to said aperture, said vapor being drawn through said aperture, and said vapor being entrained into said liquid.

20. An apparatus for mixing liquid and for entrainment mixing of vapors in liquid comprising:

a tube, magnetically coupled to a drive mechanism having an open top end and a longitudinal bore extending into said tube from an open top end to a closed bottom end, said closed bottom end forming a floor within said longitudinal bore, said tube also having an exterior bottom end, said tube further having an exterior axial surface between said open top end and said exterior bottom end, said exterior axial surface having at least one helix in the form an external screw thread, said tube also having a sidewall between said exterior axial surface and said longitudinal bore, said sidewall also defining at least one aperture for circulation of vapor.

21. An apparatus for mixing liquid and for entrainment mixing of vapors in liquid comprising:

a tube and base, that are magnetically coupled to a drive mechanism;

said tube having an open top end and a longitudinal bore extending into said tube from an open top end to a closed bottom end, said closed bottom end forming a floor within said longitudinal bore, said tube also having an exterior bottom end, said tube further having an exterior axial surface between said open top end and said exterior bottom end, said exterior axial surface having at least one helix in the form an external screw thread, said tube also having a sidewall between said exterior axial surface and said longitudinal bore, said sidewall also defining at least one aperture for circulation of vapor;

said base having a disk having a top surface and a substantially flat bottom surface, said top surface having an area greater than an area of a bottom end of said tube, said bottom end of said tube being fixedly attached to said disk such that rotational axes of said disk and said tube are substantially aligned and are substantially perpendicular to said substantially flat bottom of said disk;

at least one bar fixedly attached to or integrally molded with the top of said disk on the annular area of the top of said disk outside the perimeter of said tube, said bar aligned substantially radially from the rotational axis of said disk; and a magnet disposed within said disk.

22. An apparatus as recited in claim 21 wherein said screw thread has a thread depth at least equal to a radius of said outside surface of said tube, and further comprising:

a mixing vessel capable of containing said tube and said base; and a magnetic motor disposed beneath said mixing vessel and coupled by magnetic flux with said magnet disposed within said disk.

* * * * *